United States Patent [19]

Needham et al.

[11] Patent Number: 4,628,698

[45] Date of Patent: Dec. 16, 1986

[54] MAKING ICE IN A REFRIGERATOR

[75] Inventors: Thomas P. Needham, Burr Ridge; Frank K. Karlovits, Arlington Ht., both of Ill.

[73] Assignee: Eaton Corporation, Cleveland, Ohio

[21] Appl. No.: 689,905

[22] Filed: Jan. 9, 1985

[51] Int. Cl.[4] ..... F25C 1/00

[52] U.S. Cl. ..... 62/137; 62/233; 62/353

[58] Field of Search ..... 62/233, 135, 137, 353

[56] References Cited

U.S. PATENT DOCUMENTS

| | | | |
|---|---|---|---|
| 2,717,499 | 9/1955 | Ashby et al. | 62/233 X |
| 3,208,233 | 9/1965 | Linstromberg | 62/137 |
| 3,292,124 | 12/1966 | Legvold | 236/88 X |
| 3,339,375 | 9/1967 | Fox | 62/233 |
| 3,388,560 | 6/1968 | Moreland, II | 62/233 X |
| 3,659,430 | 5/1972 | Nichols et al. | 62/233 |
| 3,675,437 | 7/1972 | Linstromberg | 62/137 |
| 3,677,030 | 7/1972 | Nicholos | 62/353 |
| 3,826,102 | 7/1974 | Howay et al. | 62/137 |
| 3,964,269 | 6/1976 | Linstromberg | 62/137 |
| 4,142,377 | 3/1979 | Fogt | 62/135 |

*Primary Examiner*—William E. Wayner

*Attorney, Agent, or Firm*—C. H. Grace; R. A. Johnston

[57] ABSTRACT

A control system for a tray type refrigerator ice maker having a motor driven programmer for controlling ice harvest by means of tray rotation and twist for ejecting cubes to a collector bin. The programmer also drives an arm for bin level sweep, which, if interrupted by the presence of accumulated bin ice, opens a cutout switch in series with the motor. A temperature sensing curie effect magnetic switch is series connected with the bin switch and motor for delaying harvest cycle motor drive until the surrounding tray temperature is sufficiently below freezing to indicate ice presence in the tray. A heater is series connected with the motor and disposed to cause opening of the temperature sensing switch shortly after motor start. A programmer actuated by-pass switch in parallel with the temperature sensing switch is held close to continue motor drive through the remainder of the harvest cycle. The programmer actuates a separate fill valve switch during the terminal portion of the harvest cycle for energizing an electric water flow valve to refill the tray.

8 Claims, 10 Drawing Figures

Fig. 6 (a)
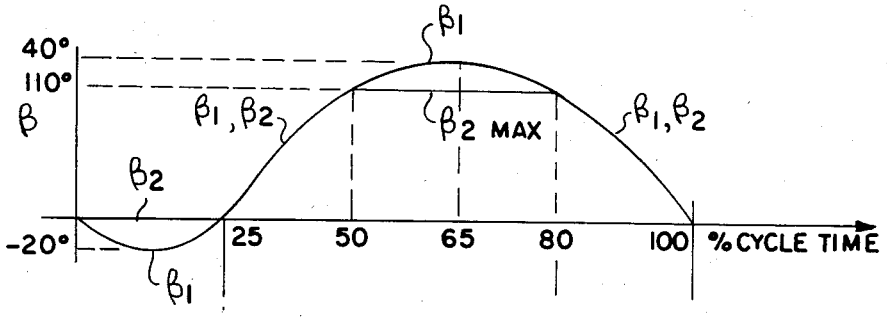
Fig. 6 (b)
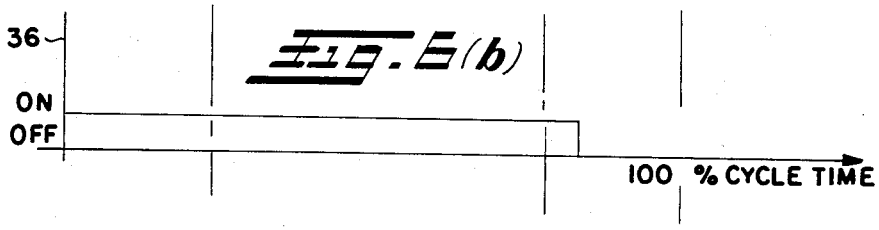
Fig. 6 (c)
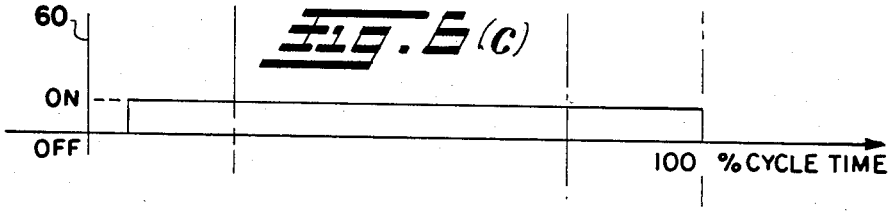
Fig. 6 (d)
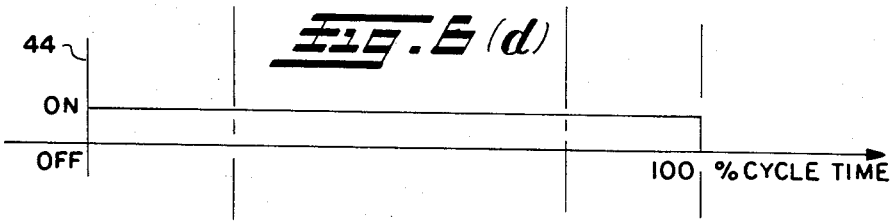
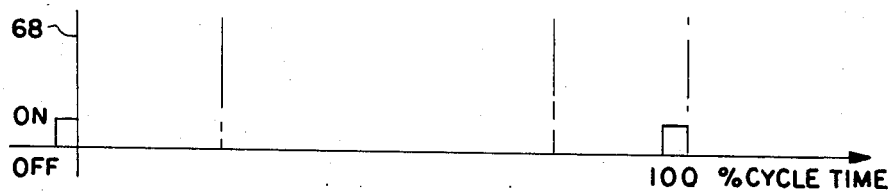
Fig. 6 (e)

MAKING ICE IN A REFRIGERATOR

BACKGROUND OF THE INVENTION

In designing repetitive batch-type ice cube makers for refrigerators, it is known to provide a rotatably mounted resilient cube tray which is twisted and rotated to eject ice therefrom during the cube harvest cycle. Such arrangements for domestic refrigerators are known to employ an electrically operated fill valve actuated to refill the tray immediately following cube harvest.

In known devices for making ice in a refrigerator of the aforesaid type, a motorized electromechanical programmer is typically employed to drive the tray twisting and rotating mechanism, and to additionally control the actuation of a switch for energizing and de-energizing the fill valve. Where an electromechanical programmer is employed for driving the mechanism for the cube harvest cycle in the aforesaid type icemakers, it is also known to employ a collector bin or receptacle for receiving the harvested ice from the tray and to have an interruptable member operated by the programmer sweep across the open rim of the bin for detecting the present of accumulated ice above the peripheral rim of the collector bin. In the aforesaid icemakers it is known to have interruption of the bin sweep member by ice accumulated above the bin operative to open a switch for cutting power to the programmer drive motor thereby terminating operation of the harvest cycle and the programmer.

In the latter type of icemaker, it is also known to employ a thermally responsive switch series connected with the programmer drive motor in order that the harvest program cycle is started by closure of the thermally responsive switch, only when the temperature sensed in the tray has reached a level indicative of hard freeze of the water in the tray.

The above described presently known tray type icemakers for refrigerators usually have the electromechanical programmer designed to actuate a switch for energizing the water flow valve upon completion of the rotation and twisting of the tray for harvesting the cubes into the bin.

However, in operation of known twist tray ice cube makers for refrigerators, and particularly those of the type employing a motorized mechanical programmer, it has been found that, upon completion of the cube harvest cycle, there may be insufficient heat transfer from the tray water refill to reset or open the thermally responsive switch in series with the programmer motor. This has been found to be particularly a problem where a cube fails to eject from the tray in the vicinity immediately adjacent the temperature responsive sensor in the tray. Such failure of the cube to be ejected near the sensor has caused the sensor switch to not be reset to the open position for stopping the harvest cycle. Therefore, it has long been desired to find a way or means of positively resetting the thermally responsive switch means upon completion of the ice harvest cycle in tray type refrigerator icemakers.

SUMMARY OF THE INVENTION

The present invention relates to twist tray type ice cube makers for use in a refrigerator. In particular, the invention relates to ice cube makers of this type which employ a motorized electromechanical programmer to provide the sequence of operation for rotating and twisting the tray and operation of electrical switches for controlling water fill for the next cube freeze following cube harvest.

The present invention employs a motor driven speed reducer mechanism and associated programmer for rotating an ice cube tray and effecting twist of the tray for ejection of ice cubes as part of an ice harvest cycle. The harvest cycle is initiated upon a temperature sensor, in the form of a Curie effect magnetic reed switch embedded in the tray, closing upon the tray reaching a temperature indicating a hard freeze of the water contained therein. An electrical resistance heating device is disposed adjacent the magnetic reed switch and begins to heat the switch as the harvest cycle is begun. A by-pass or shunt switch is actuated by the programmer in order to maintain current flow to the programmer drive motor when the thermal sensor switch is reset by heating.

In the preferred embodiment, the thermal sensor comprises a Curie effect magnetic reed switch with a heating element wrapped therearound which assembly is received in a cavity provided in the end of the tray just beneath the cube forming cavities of the tray.

The present invention thus provides a twist tray type ice cube maker for refrigerator in which the cube harvest cycle is provided by a motor driven electromechanical programmer. The harvest cycle is initiated upon a thermally sensitive switch embedded in the tray being actuated upon sensing hard freeze of the water in the tray and simultaneously a heating element is energized to positively reset or re-open the thermal sensing switch. The thermal sensing switch is in series with the programmer drive motor and upon energization of the programmer drive, a shunt or by-pass switch closes to maintain the programmer motor operation beyond reset of the thermal sensing switch.

The present invention thus provides a unique and novel control system for a twist tray type ice maker for use in a refrigerator wherein the thermal sensing switch employed for initiating the cube harvest cycle is automatically and positively reset by an electrical heating element in series therewith and disposed about the thermal sensing switch.

DETAILED DESCRIPTION OF THE DRAWINGS

FIG. 1 a somewhat perspective view of the icemaker of the present invention as installed on the inner surface of the wall of a refrigerator cabinet;

DETAILED DESCRIPTION

Figure 1:
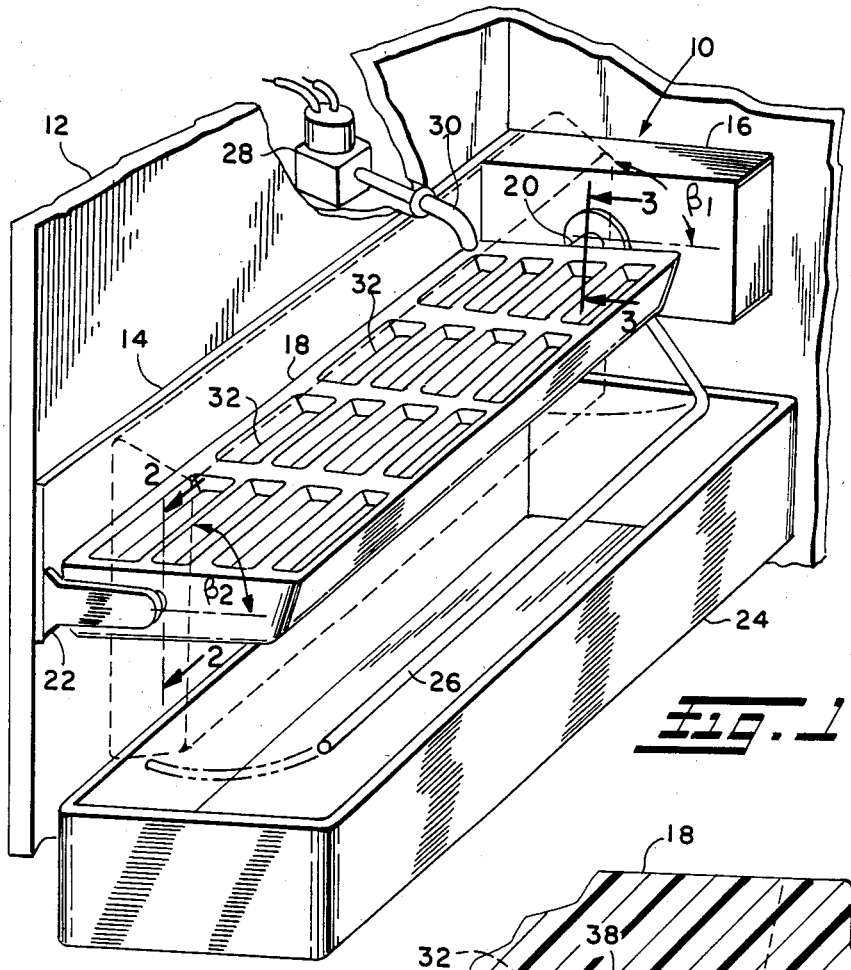
Figure 4:
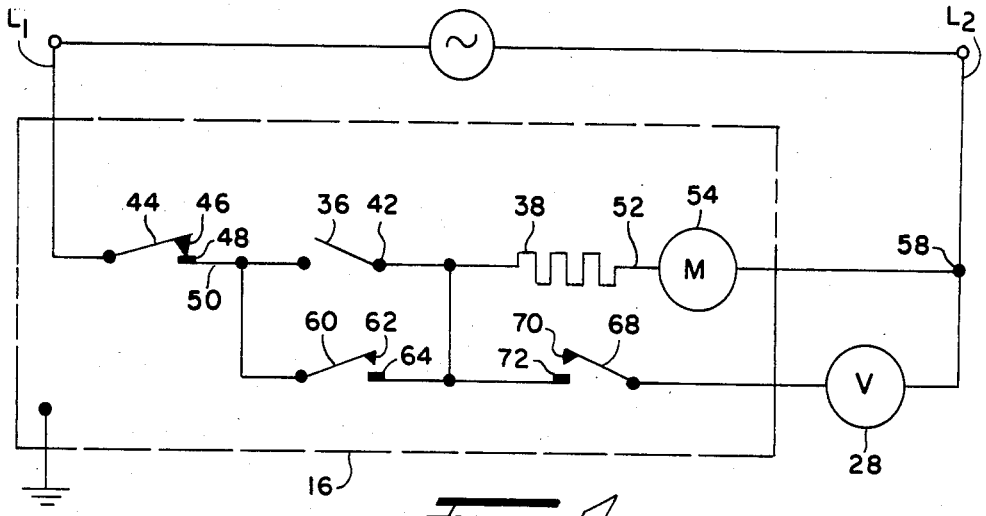
FIG. 4 is a schematic of the motor control and solenoid valve energizing circuit of the embodiment of FIG. 1.
Figure 5:
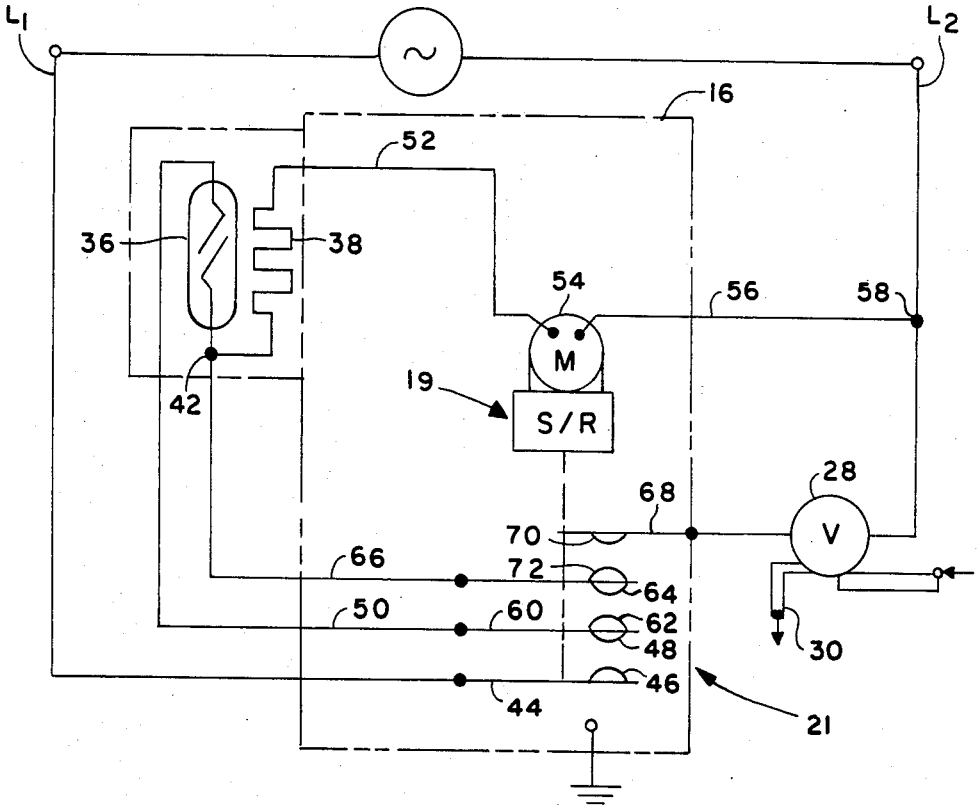
FIG. 5 is a wiring schematic of the thermal sensing switch, motor solenoid valve and programmer switches of the present invention; and, FIGS. 6(*a*)–6(*e*) are timing sequence diagrams for the actuation of the switches and the twisting of the tray.

Referring now to FIGS. 1, 4 and 5 the icemaker assembly indicated generally at 10, is shown installed on the interior of a refrigerator cabinet wall 12 and has a mounting plate 14 having secured thereon a programmer 16 including therein a motorized speed reducing gear drive. A cube tray 18 is pivotally connected at one end thereof to the programmer 16 by means of a shaft 20 extending from one end of the tray. The opposite end of the tray is pivotally supported on a support bracket 22 which extends from the mounting plate 14.

An ice cube receiving bin 24 is disposed immediately below the tray and a bin sweep arm 26 depends from the programmer gear drive 16 for sweep movement across the top of the bin 24 as indicated by the dashed line in FIG. 1.

An electrically operated water fill valve 28 is provided and the outlet thereof connected to a tube 30 which is received through the wall of the refrigerator cabinet 12 and the end of the tube is disposed vertically above the cube tray 18 for providing water fill thereto.

The speed reducer indicated generally at 19 comprises a suitable motor and gear reduction mechanism which may be of any convenient form well known in the art and the details thereof are omitted herein for simplicity. The programmer 16 also includes a plurality of electrical switches indicated generally at 21 mechanically actuated by a suitable timed cam means (not shown) which is also driven by the motor-gear mechanism of the speed reducer for providing the various switching functions in the desired sequence during the harvest cycle of the period. The details of the electromechanical drive for the switches have also been omitted for simplicity; as, these are well known in the art and may comprise any suitable mechanical arrangement for effecting the desired sequential operation of the switches. Similarly, the details of the mechanical linkages for effecting movement of the bin sweep arm 26 have also been omitted for simplicity.

It will be understood that the tray shaft 20 engages the speed reducer drive 19 by any suitable expedient, as, for example, a polygonal transverse shape of shaft 20 engaging a corresponding shape on a drive gear or hollow drive shaft. The details of the tray rotating mechanism have likewise been omitted for simplicity, as, these are well known in the art.

Figure 3:
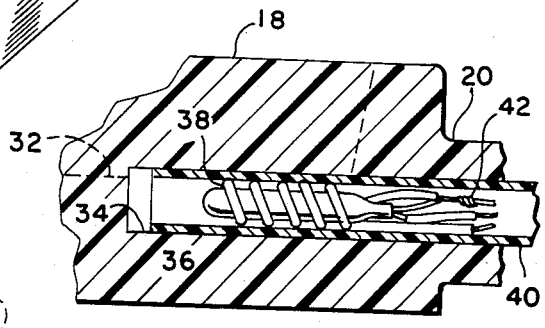
FIG. 3 is a portion of a section view taken along section indicating lines 3—3 of FIG. 1.

Referring now to FIGS. 1 and 3, the tray 18 has a plurality of cube cavities 32 formed therein on the upper surface thereof and has a bore 34 provided in the end of shaft 20, which bore 34 extends longitundinally of the tray between and adjacent the lower surface of the inner most pair of cavities adjacent the end of the tray. A thermally responsive Curie effect magnetic reed switch 36 has an electrical heating element in the form of conductor 38 disposed spirally therearound and a plastic sheath 40 is received thereover. The electrical leads from the heater 38 and the reed switch 36 extend rightwardly in FIG. 3 beyond the end of the sheath 40 for connection with other elements of the control circuit of FIGS. 4 and 5. In the presently preferred practice one lead each of the switch 36 and heater 38 are junctioned, as for example by soldering, at 42 within the sheath, and immediately adjacent the switch 36, so that only three leads need extend outwardly from the sheath 40.

In the present practice of the invention, it has been found satisfactory to use a magnetic reed switch supplied by TDK Corp. of American, 4709 Golf Rd., Suite 300, Skokie, Ill. 60076, bearing manufacturer's designation TR-N7, 2B10; however, other commercially available switches may be employed.

The sheath 40, with the switch and heater disposed therein, is received in the bore 34 in rotary sliding engagement; and, the end of the sheath 40 is anchored in a stationary or non-rotating manner in the housing of programmer 16.

Referring now to FIGS. 4 and 5, one side of a power supply line such as 115 volt 60 cycle a.c. household supply is connected via lead $L_1$ to one lead of the bin sensing switch 44 which is operatively connected to be closed on interruption of the bin arm sweep by a suitable mechanism (not shown) within the programmer 16. In the presently preferred practice, the bin sweep arm 26 is spring loaded such that in the event its sweep is interrupted by accumulated ice piled above the bin, upon removal of the ice or melting thereof, the bin stroke is completed by the spring loaded mechanism which permits switch 44 to close.

Switch 44 has a set of contacts 46, 48 with a second lead 50 connected to contact 48 which lead is also connected to one lead of reed switch 36. The remaining lead of the reed switch is connected to junction 42 which is also connected to one lead of the heater element 38 with the remaining lead 52 of the heater element 38 connected one side of the drive motor 54. The remaining lead 56 from the motor is connected to a junction 58 on the opposite side $L_2$ of the power line.

The motor employed is a sub-fractional horse power synchronous timing motor having a power rating of about three watts at 120 volts a.c. line power. It will therefore, be understood that the heater 38 must reach its desired temperature on a current of about 0.25 ampere.

A by-pass or shunt switch 60 having contacts 62, 64 has one lead 66 thereof connected to junction 42 and the other lead thereof common with lead 50. In the presently preferred practice, this is accomplished by contact 62 and 48 being arranged in back-to-back arrangement on common switch arm 60 as shown in the switch stack 21 of FIG. 5.

A fill valve switch 68 having contact 70, 72 is also provided, with contact 72 thereof preferably formed in back-to-back relationship with contact 64 of switch 60 as shown in FIG. 5.

The fill valve 28 has one lead thereof connected to power line junction 58 and the remaining lead thereof connected to switch 68.

Referring now to FIGS. 1, 5 and 6, in operation, reed switch 36 is normally open at ice-water temperatures above 32° F. (0° centrigrade) and upon the temperatures of the ice water in the tray dropping to approximately 4° F. (2° centigrade) below freezing, reed switch 36 closes thereby permitting current to flow through the heater element 38 and to the motor 54, provided that bin switch 44 is in its normally closed position as is the case when the bin 24 is less than full. As motor 54 continues operation of the speed reducing gear mechanism 19 in the programmer 16, the various programmer operated switches 68, 60, 44 are caused to operate in programmed sequence.

Simultaneously, with onset of programmer motor and gear drive operation, the tray shaft 20 is caused to turn, initially in a negative or clockwise direction with respect to FIG. 1 causing the end of the tray 18 adjacent the programmer to rotate through an angle as represented by the angle $\beta_1$ as shown in FIG. 1. The opposite end of the tray supported by support 22 is restrained from motion; and, consequently the angle of rotation $\beta_2$ thereof is zero for a predetermined initial portion, preferably about 25% of the harvest cycle program as shown in FIG. 6A.

Shortly after initial closure of reed switch 36 and onset of programmer operation, by-pass switch 60 is closed mechanically by the programmer as shown in FIG. 6C and remains closed thereafter for the duration of the harvest cycle. In the presently preferred practice, the programmer is set to provide a complete harvest cycle in about six (6) minutes and the reed switch 36 must have opened before about 90% of this time as shown in FIG. 6B. The switch 36 is heated sufficiently by heater 38 to reset and to the open position. However, it will be understood that the reed switch 36 may open anytime after switch 60 is closed in order that the motor will continue to operate throughout the harvest cycle.

In the presently preferred practice, the programmer is set to cause the bin sweep arm 26 to sweep across the bin 24 at about 25% of the harvest cycle and, if at this point, the sweep arm traverse is interrupted by the presence of accumulated ice piled in the bin, switch 44 will be opened by the interruption of the sweep of arm 26. However, if the bin sweep is completed, switch 44 will remain closed and the harvest cycle will continue.

Figure 2:
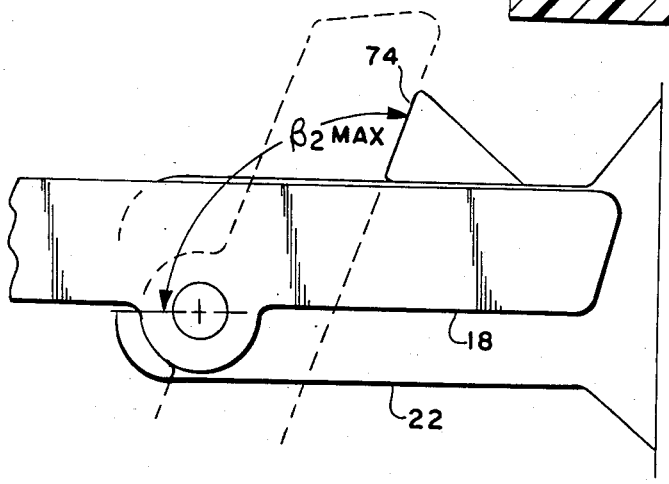
FIG. 2 is a portion of a section view taken along section lines 2—2 of FIG. 1.

As the tray is rotated back to its initial position with the angle $\beta_1=0$ and the end of the tray adjacent the programmer is in a horizontal position. The programmer then continues to rotate the tray in the positive or counterclockwise direction as viewed in FIG. 1 with both ends of the tray free to rotate such that angle $\beta_1$=angle $\beta_2$ and the tray is untwisted until angle $\beta_2$ reaches a maximum of approximately $+110°$ whereupon at maximum $\beta_2$, the tray end remote from the programmer comes in contact with a stop 74, as shown in FIG. 2, wherein the position of maximum rotation of the end of the tray remote from the programmer is illustrated in dashed outline.

With reference to FIG. 6(*a*), the tray end remote from the programmer makes contact with the stop 74 at approximately 50% of the harvest cycle. Tne programmer continues to rotate the end of the tray adjacent the programmer to a maximum value of about $+140°$ which is at about 65% of the cycle time, thus inducing a about 30° twist in the tray as between opposite ends, the purpose of which is to distort the cavities and eject ice into the bin.

The programmer having reached $\beta_1$ max., again reverses direction of rotation and begins rotating the tray in a clockwise direction with respect to FIG. 1. Continued clockwise rotation returns the tray to the horizontal position with the cavities open upward and follows the curve for $\beta_1$, $\beta_2$ as shown in FIG. 6(*a*) for the portion of the cycle between 65–100% of the cycle time. As the programmer reaches the end of the harvest cycle rotation of the tray, the thermally responsive reed switch 36 is open and remains open until refreeze occurs.

At the terminal portion of the harvest cycle, and just as the tray is nearing its horizontal position, the motorized gear mechanism 19 within programmer 16 is operative to cause the fill valve switch 68 to close for the remaining duration of the cycle to provide a timed flow of water to refill the tray cavities. When the programmer reaches the end of the harvest cycle, the motor gear mechanism within the programmer is operative to cause switch 60 to open; and, in view of the switch 36 having been already reset to the open position, power is cut off to the motor 54 and the fill valve 68. This power cut-off causes termination of the harvest cycle and stopping flow of fill water to the tray. The icemaker is then dormant until such time as the reed switch 36 senses refreeze and the harvest cycle is again commenced by closure of switch 36.

The present invention thus provides a novel and unique twist tray type icemaker for a refrigerator having a thermally responsive sensor for activating the cube harvest cycle upon sensing a hard freeze in the ice tray. An electrically heating element is series connected with the thermal sensor and the harvest cycle drive motor such that initiation of the current flow in the motor causes heating of the electrical element which thereby causing the sensor to be heated and reset to the open position during the course of the harvest cycle. The programmer provides for actuating the by-pass switch to continue current flow to the motor upon reset of the thermal sensor.

The present invention thus provides a unique and novel icemaker for refrigerator whereupon positive reset of the thermal sensing element during the harvest cycle is provided in order to assure proper operation during a subsequent cube freeze cycle. Although the invention has hereinabove been described with respect to the illustrated embodiments, it will be understood that modifications and variations to the invention may be made; and, the invention is limited only by the following claims.

We claim:

1. A system for making ice in a refrigerator comprising:

a. tray means for receiving water to permit ice to form therein, said tray means mounted for pivotal movement in said refrigerator for harvesting ice;

b. motor means including speed reducer means connected to said tray means and operable upon energization to pivot said tray means for harvesting ice;

c. fill valve means adapted for connection to a water line and operable upon energization to provide water flow to said tray means;

d. control circuit means operative, upon connection to a source of electrical power, to effect energization and de-energization of said motor means, said circuit means including;

i. thermally responsive switch means disposed to sense the temperature of the water in said tray means, said thermally responsive switch means being open circuit at temperatures above freezing and closing upon the sensed temperature dropping below freezing by a desired amount, said thermally responsive switch means series connected with said motor means, ii. heater means disposed adjacent said thermally responsive means said heater means series connected with said motor means and effective to upon energization to cause heating of and opening of said thermally responsive switching means;

iii. shunt switch means by-passing said thermally responsive means;

iv. cut-off switch means series connected with said thermally responsive means, said heater means and said motor means, said cut-off switch means normally closed.

v. filling switch means operative upon actuation and deactuation to energize and de-energize said fill valve means for effecting and terminating water flow to said tray means;

vi. switch programmer means drivingly connected to said speed reducer means and operative to sequentially close said shunt switch means a first predetermined interval after said thermally responsive switch means closes and operative to maintain said shunt switch means closed for a predetermined cycle interval and further operative to close said filling switch means for a predetermined terminal portion of said cycle interval and further operative to open said shunt switch means and said filling switch means at the end of said cycle interval;

e. bin means disposed to receive and store harvested ice from said tray means; and, f. ice sensing means drivingly connected to said speed reducer means and operative within a second predetermined interval after closing of said by-pass switching to detect the presence or absence of harvested ice in said bin means and means upon detection of the presence of harvested ice operative to open said cut-off switch means and in the absence of harvested ice operative to maintain said cut-off switch means normally closed.

2. The control system defined in claim 1, wherein said thermally responsive switch means comprises a switch magnetically actuated by the curie effect upon experiencing temperatures the desired amount below freezing.

3. The control system defined in claim 1, wherein said filling switch means and said by-pass switch means are electrically seires connected.

4. The control system defined in claim 1, wherein said first predetermined interval does not exceed 20 seconds duration.

5. The control system defined in claim 1, wherein said second predetermined interval does not exceed one and one-half minutes.

6. The control system defined in claim 1, wherein said cycle interval comprises six minutes.

7. The control system defined in claim 1, wherein said predetermined terminal portion of said cycle interval comprises a sub-interval in the range of 12–15 seconds.

8. A system for making ice in a refrigerator comprising:

a. tray means for receiving water to permit ice to form therein and mounted for movement to harvest ice therefrom;

b. motor means including speed reduction means operative to effect said movement of said tray means for ice harvesting;

c. bin means disposed in said refrigerator for receiving harvested ice;

d. temperature sensing switch means operable upon experiencing the temperature in said tray means falling below a predetermined level less than freezing to complete a circuit and operable upon the refrigerator temperature rising above the freezing level to break the circuit;

e. heater means disposed adjacent said temperature sensing switch means and electrically series connected therewith and series connected with said motor means, said heater means operative to cause said temperature sensing switch to open within a predetermined thereby resetting said temperature sensing switch means;

f. shunt switch means operative to by-pass said temperature switch means;

g. programmer means connected to said speed reduction means and operative to effect actuation of said shunt switch means prior to resetting of said temperature sensing switch means; said programmer means also operative to control the harvest cycle of said tray means;

h. fill valve means operable upon energization by said programmer measn to permit a predetermined flow of water to said tray means.

* * * * *